United States Patent [19]

Brown et al.

[11] Patent Number: 4,714,860

[45] Date of Patent: Dec. 22, 1987

[54] ION BEAM GENERATING APPARATUS

[76] Inventors: Ian G. Brown, 1088 Woodside Rd., Berkeley, Calif. 94708; James Galvin, 2 Commodore #276, Emeryville, Calif. 94608

[21] Appl. No.: 696,460

[22] Filed: Jan. 30, 1985

[51] Int. Cl.[4] ..... H01J 7/24; H05B 31/26

[52] U.S. Cl. ..... 315/111.81; 250/425; 313/230; 313/231.41; 315/111.31; 315/111.41

[58] Field of Search ..... 315/111.81, 111.91, 315/111.41, 111.31; 313/230, 231.41, 630; 250/425, 423 R

[56] References Cited

U.S. PATENT DOCUMENTS

| | | | |
|---|---|---|---|
| 2,677,061 | 4/1954 | Wilson | 315/111.91 |
| 2,882,409 | 4/1959 | Lawrence | 250/41.9 |
| 3,356,897 | 12/1967 | Barr et al. | 313/231.41 X |
| 3,389,289 | 6/1968 | Bensussan et al. | 313/180 |
| 3,409,529 | 11/1968 | Chopra et al. | 204/192 |
| 3,517,240 | 6/1970 | Dickinson | 313/230 X |
| 3,566,185 | 2/1971 | Gavin | 315/111.81 |
| 4,123,686 | 10/1978 | Keller et al. | 313/231.41 |
| 4,301,391 | 11/1981 | Seliger et al. | 315/111.21 |
| 4,320,251 | 3/1982 | Narasimhan et al. | 136/256 |
| 4,407,712 | 10/1983 | Henshaw et al. | 204/298 |
| 4,442,382 | 4/1984 | Hill | 315/111.81 |
| 4,570,106 | 2/1986 | Sohval et al. | 315/111.81 |

OTHER PUBLICATIONS

"Pulsed Metallic-Plasma Generator", by S. Gilmour, Jr. et al, Proceedings of IEEE, Aug. 1972, vol. 60, No. 8.

*Primary Examiner*—Saxfield Chatmon

*Attorney, Agent, or Firm*—Bielen & Peterson

[57] ABSTRACT

An ion generating apparatus utilizing a vacuum chamber, a cathode and an anode in the chamber. A source of electrical power produces an arc or discharge between the cathode and anode. The arc is sufficient to vaporize a portion of the cathode to form a plasma. The plasma is directed to an extractor which separates the electrons from the plasma, and accelerates the ions to produce an ion beam.

10 Claims, 10 Drawing Figures

ION BEAM GENERATING APPARATUS

STATEMENTS AS TO RIGHTS OF INVENTION MADE UNDER FEDERALLY SPONSORED RESEARCH AND DEVELOPMENT

The government has rights in this invention pursuant to contract No. DE-AC03-76SF00098 awarded by the U.S. Department of Energy.

BACKGROUND OF THE INVENTION

The present invention relates to a novel ion generating apparatus.

Ion beams have been created in many ways in the prior art. Ion species that are gaseous may be formed by creating a plasma from the gaseous source and extracting ions therefrom to create an ion beam. However, when the desired ion species is metallic, the problem exists in producing a plasma from the metal. In the past, hot metal vapor has been produced by elevating the metallic source to a very high temperature. For example, U.S. Pat. No. 2,882,409 describes a plasma formation by heating a metallic filament. In addition, there are certain cases where metallic gases exist at or near room temperature, but these situations are rare.

Two types of ion sources typically employed in accelerators are the: Phillips Ion Gage Ion Source (PIG) and the Duoplasmatron Ion Source.

The Duoplasmatron source forms a hot cathode arc with an intermediate electrode to constrict the discharge and to create an inhomogeneous magnetic field that concentrates the plasma near the extraction aperture in the anode. For example, U.S. Pat. No. 3,409,529 describes this type of ion source. Although the Duoplasmatron Source produces a very high ion current, it is suited for production of gaseous ions rather than metallic ions.

The PIG source utilizes two cathodes placed at the end of a cylindrical hollow anode. A magnetic field is established parallel to the anode's axis. The cathodes are at the same negative potential with respect to the anode. Electrons created by ionization of gas atoms are accelerated toward the anode but are constrained to follow the magnetic field and are thereby prevented from moving radially to the anode. Electrons oscillate between the cathodes and continue to ionize the background gas creating enough electrons to continue the ionization process. The anode typically contains a slit and an extraction electrode external to the anode. Positive ion bombardment sputters material from the cathode to form a plasma from which ions are extracted near the anode slit. Sputtering of metallic ions may be enhanced by the addition of a separate sputtering electrode. The PIG source can be used for the creation of beams of metallic ions. However, the ion beam currents achieved using the PIG souce are relatively small. U.S. Pat. No. 3,566,185 describes an ion source of this type.

U.S. Pat. No. 3,389,289 describes a plasma gun which employs powdered titanium hydride which is placed between electrodes to form a spark gap. Energizing of the electrodes produced a plasma burst.

U.S. Pat. No. 4,320,351 shows the production of an arc plasma which is sprayed onto a silicon body or wafer. The plasma is produced by injecting a powder into an arc gas stream which melts or softens the powder and propels it toward the article to be sprayed.

An article by Gilmore and Lockwood entitled Pulsed Metallic Plasma Generator published in the Proceedings of the I.E.E.E., Volume 60, #8 of August 1972 describes the production of a plasma by a vacuum arc. This method describes the placement of two electrodes in a vacuum and the establishment of an electrical discharge between them. Material from the negative electrode is vaporized and ionized by the arc to produce a metallic plasma.

U.S. Pat. No. 4,407,712 describes a sputtering technique used to plate a hollow cathode.

None of the prior art alone or in combination has described an ion beam generator for the efficient production of high current beams of metallic ions. Such a device would be a great advance in the field of production of ion beams.

SUMMARY OF THE INVENTION

In accordance with the present invention a novel and useful apparatus for generating an ion beam is provided.

The apparatus of the present invention utilizes a vacuum chamber. A cathode constructed of the working material for source of ions is placed in the vacuum chamber and spaced apart from an anode. The anode may be held in place by a conical member which is heat conductive. The anode includes an opening which permits passage of the plasma jet generated by the apparatus. An electrical source is applied to the anode and cathode to provide an electrical potential therebetween. Cooling may be applied to a flange end of an anode holder.

Means may be also provided for producing an electrical arc between the cathode and anode. The arc would be of sufficient magnitude to vaporize a portion of the cathode and to form a plasma which moves toward the anode and then passes through the opening in the anode. Such arc producing may be initiated by a trigger electrode which may be formed concentrically with the cathode. A pulsing spark is generated between the trigger electrode and the cathode by an electrical circuit. Since the trigger electrode requires a high voltage, an insulator would be placed between the trigger electrode and the cathode. Cooling would also be applied to the cathode. A magnetic field is established to confine and guide the plasma jet from the cathode towards the anode and through the anode opening. Such a magnetic field is established by a coil that surrounds the anode opening. Such means for applying a magnetic field may also include a cooling system for the same.

Means for extracting ions from the plasma plume passing through the anode is also provided. Such extracting means may externalize in a set of grids or electrodes located a selected distance beyond the anode in the vacuum chamber. The ions extracted from the plasma jet accelerate into an ion beam.

It may be apparent that a novel and useful ion generating apparatus has been described.

It is therefore an object of the present invention to provide an ion generating apparatus which employs a metal vapor arc as a source of plasma.

It is another object of the present invention to provide an ion generating apparatus which employs a high density plasma originating from a solid metal or metal compound which may be transformed into an ion beam.

Another object of the present invention is to provide an ion generating apparatus which employs a low wear cathode.

A further object of the present invention is to provide an ion generating apparatus which eliminates the sputtering process of producing a plasma and corresponding metal buildup on an anode from the same.

Yet another object of the present invention is to provide an ion generating apparatus in which metal ions are capable of combining with gases in a vacuum chamber to "pump" the same therefrom.

Another object of the present invention is to provide an ion generating apparatus which employs a plasma which possesses a high degree of stability.

A further object of the present invention is to provide an ion generating apparatus which includes a charge state distribution for the ions which is repeatable.

There is a further object of the present invention to provide an ion generating apparatus which provides an ion beam having a low beam emittance.

Another object of the present invention is to provide an ion generating apparatus which produces an ion beam having a very high beam current.

Yet another object of the present invention is to provide an ion beam generating apparatus which produces useful currents of high charge state ion species.

Another object of the present invention is to provide an ion generating apparatus which produces an ion beam having a very high beam current.

The invention possesses other advantages and objects especially as concerns particular characteristics and features thereof which will become apparent as the specification continues.

Figure 1:
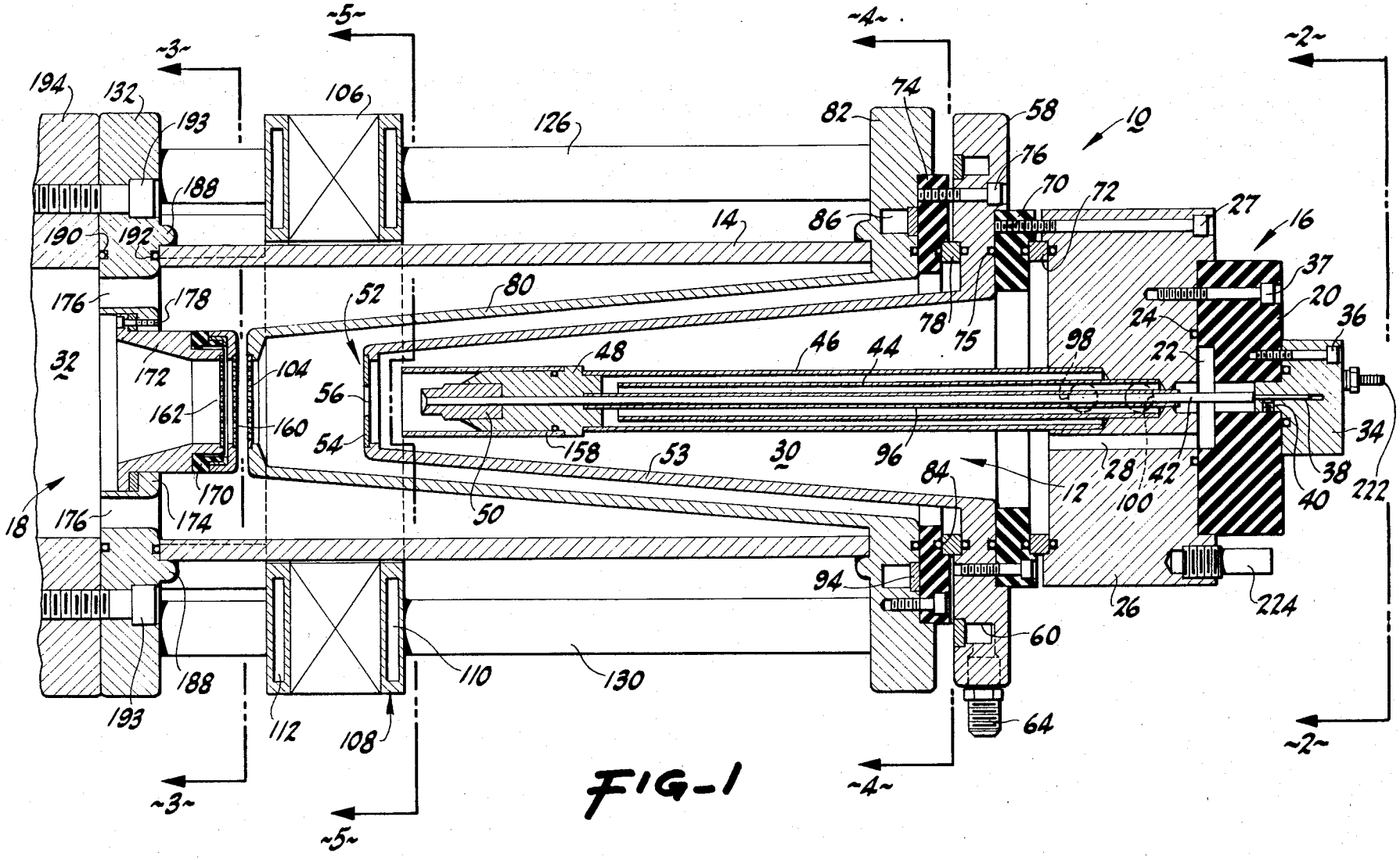
FIG. 1 is an axial sectional view of the apparatus of the present invention.

For a better understanding of the invention reference is made to the hereinafter described preferred emobidments of the present invention which will be referenced to the hereinabove described drawings.

DESCRIPTION OF THE PREFERRED EMBODIMENTS

Various aspects of the present invention will evolve from the following detailed description of the preferred embodiments thereof which should be referenced to the hereinabove described drawings.

The apparatus as a whole is shown in the drawings by reference character 10 and includes as one of its elements a vacuum chamber 12. Vacuum chamber 12 is formed between cylindrical member 14, first end portion 16, and second end portion 18 of apparatus 10. Cylindrical member 14 may be formed of quartz or other suitable material. Insulator 20 provides a vacuum space 22 which is sealed by 'O' ring 24. Metallic member 26 includes a passage 28 between vacuum space 22 and vacuum space 30 of vacuum chamber 12. Insulator 20 fastens to metallic member 26 via screws 37. Evacuation of vacuum chamber would take place at second end portion 18 of apparatus 10 in vacuum space 32. Metallic member 34 is fastened to insulator 20 via plurality of screws 36, FIGS. 1 and 2. Control electrode 38 is held in metallic member 34 by set screw 40. Metallic members 26 and 34 may be constructed of copper while trigger electrode 38 may be constructed of tantalum which is resistent to deterioration under high heat. Insulator 42, composed of material such as alumina, surrounds control electrode 38 along its length extending from metallic member 34. Tubes 44 and 46 are concentrically disposed in relation to insulator 42 and may be constructed of heat conductive material such as copper. Base piece 48 abuts tube 46 and serves as a seat for cathode 50. Anode 52 is formed of electrically conductive material such as aluminium, stainless steel and the like and terminates in an anode plate 54 having opening 56 therethrough. Anode 52 has a conical holder 53 which terminates in a flange or plate 58, FIGS. 1 and 2. Flange 58 includes an annular opening 60 having a plug 62 for separating the inlet 64 and outlet 66 for the coolant such as freon. Annular groove 60 is capped by filler 68. Insulator 70 abuts flange 58 and anode holder 53. Metal ring 72 lies between metallic member 26 and insulator 70. Plurality of 'O' rings 75 seals metallic member 26, ring 72, insulator 70 and annode flange 58 against leakage of ambient air into vacuum chamber 12. Member 26 fastens to insulator 70 with screws 27.

Anode flange 58 is fastened to insulator 74 by the use of fastening means 76. Metallic ring 78 lies between flange 58 of anode 52 and insulator 74.

Grid holder 80 surrounds anode holder 53 and includes a flange 82. Flange 82 sandwiches insulator 74 between itself and flange 58 of anode 52. Plurality of 'O' rings 84 seal against leakage in the same manner as 'O' rings 75 heretofore described. Flange 82 includes an annular chamber 86 which permits cooling fluid to circulate therethrough. A plug 88 separates inlet 90 from outlet 92, FIG. 2, similar to the structure described for annular chamber 60 in relation to anode flange 58. Filler 94 provides a seal for annular chamber 86.

Figure 6:
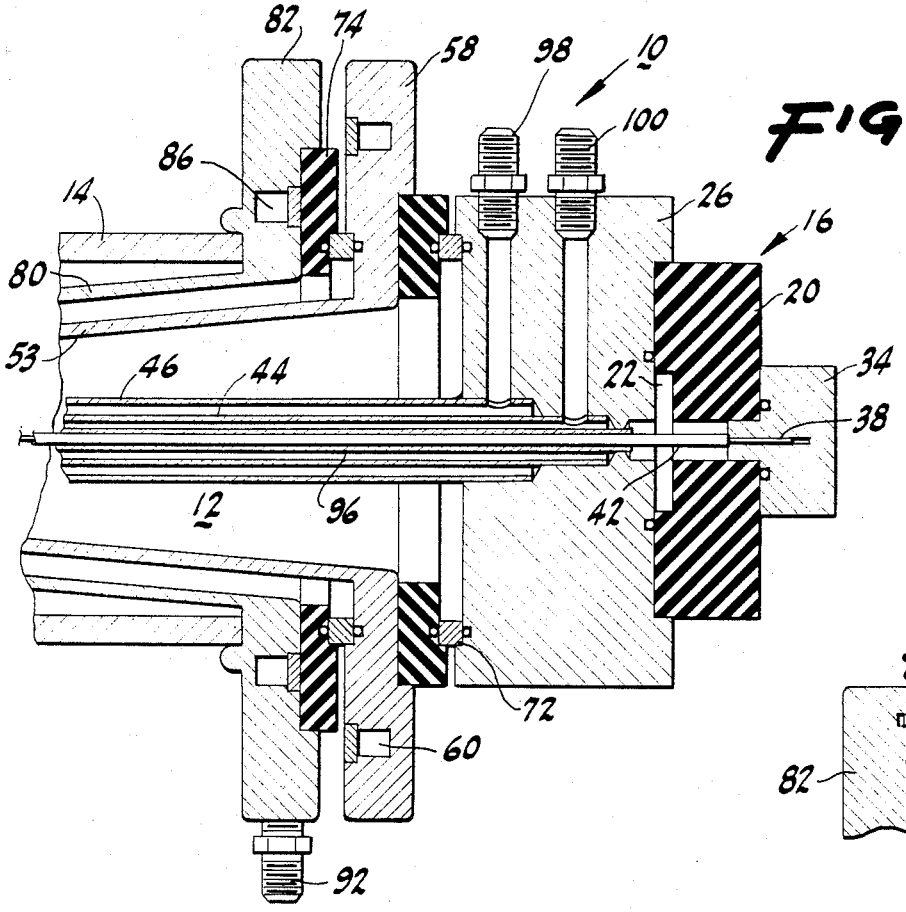
FIG. 6 is a view taken along line 6—6 of FIG. 2.

Turning to FIG. 6, it may be seen that a metallic tube 96 surrounds insulation covering 42 along its length. Coolant is also provided to the space between tube 44 and tube 46 from inlet 98. The coolant impinges on the end of base piece 48, FIG. 1 and returns through the space between tubes 44 and 46 and through outlet 100.

Figure 5:
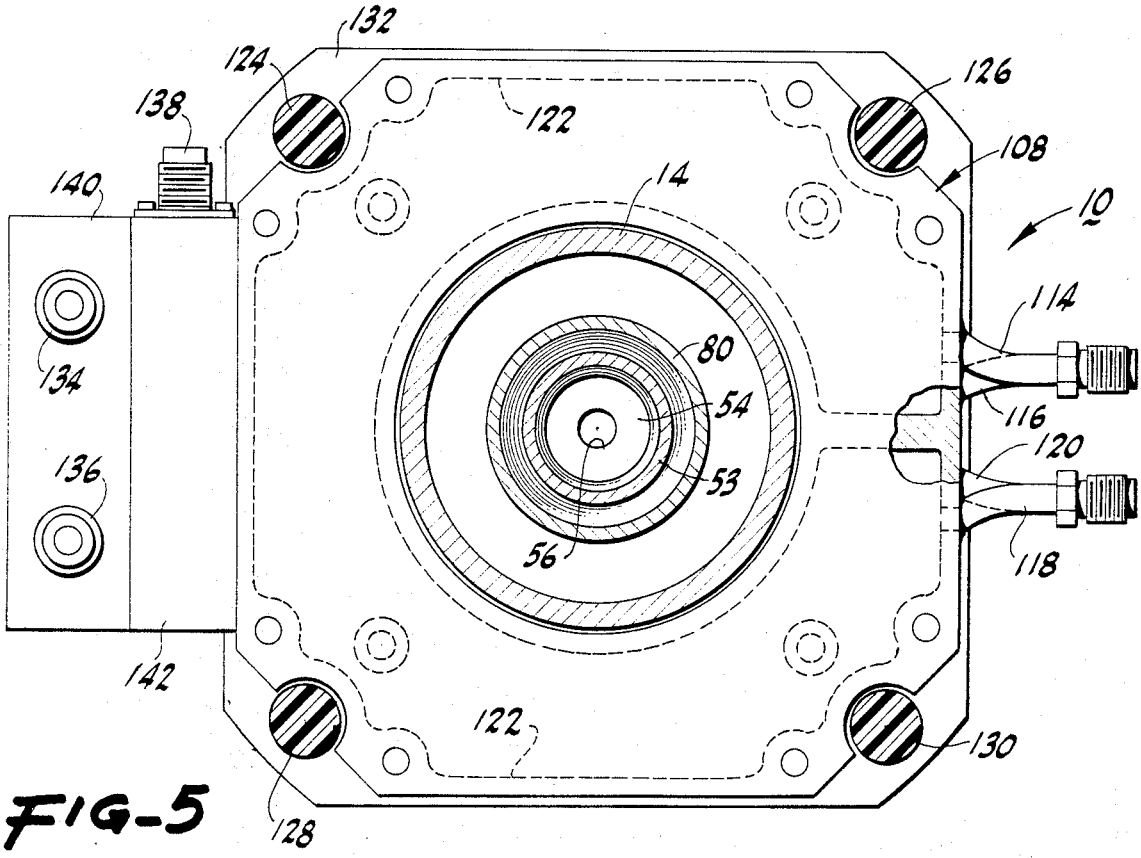
FIG. 5 is a view taken along line 5—5 of FIG. 1.

Grid holder 80 terminates in a stepped member which holds an electrical grid 104. Opening 56, anode 52, cathode 50, and grid 104 are axially aligned. Magnet coil 106 (shown schematically) surrounds the region of anode plate 54. Frame member 108 holds magnet coil in place and consists of a pair of hollow plates 110 and 112 on either side of magnet coil 106. With reference to FIGS. 1 and 5, cooling is also applied to hollow plates 110 and 112 through inlets 114 and 116 and outlets 118 and 120 respectively. Plurality of cylindrical spacers 122 hold plates 110 and 112 together. Likewise, cylindrical bars 124, 126, 128 and 130 hold flange 82 to end plate 132. Electrical terminals 134 and 136 connect the electrical power to magnet coil 106. Terminal 138 serves as a connector to temperature overload switch 228, FIG. 9. These electrical terminals are mounted on blocks 140 and 142, FIG. 5. Further, spacer cylindrical bars 124, 126, 128 and 130 are held to flange 82 and plate 132 via plurality of fasteners 144, FIG. 2 and 146, FIG. 3.

Figure 2:
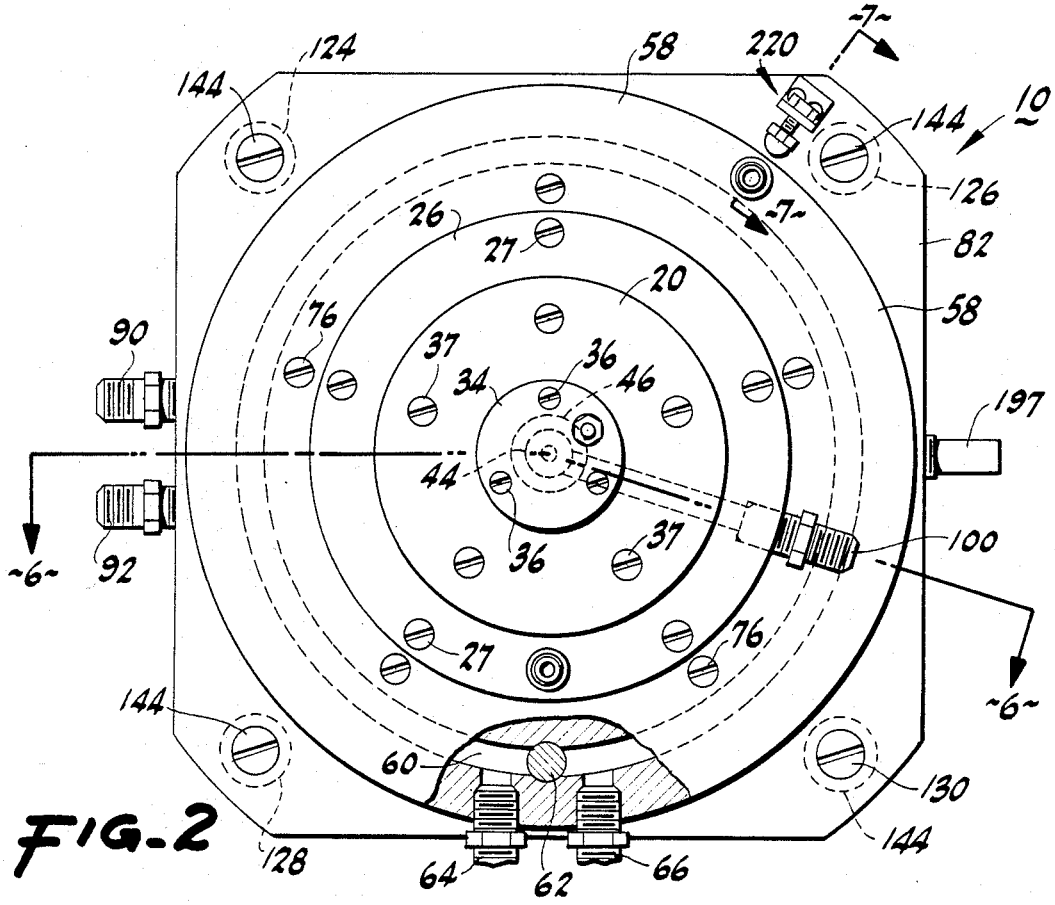
FIG. 2 is a view taken along line 2—2 of FIG. 1.
Figure 7:
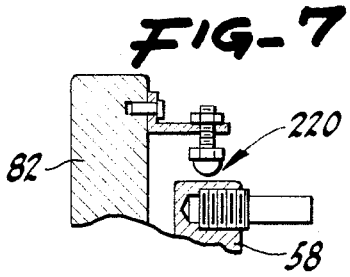
FIG. 7 is a sectional view taken along line 7—7 of FIG. 2.

FIG. 7 depicts a spark gap mechanism 220 which is mounted between plate 82 and flange 58, FIG. 2. Mechanism 220 prevents electrical breakdown between various components of apparatus 10 during electrical conditioning or operation, and confines any spurious discharge to spark gap 220.

Figure 8:
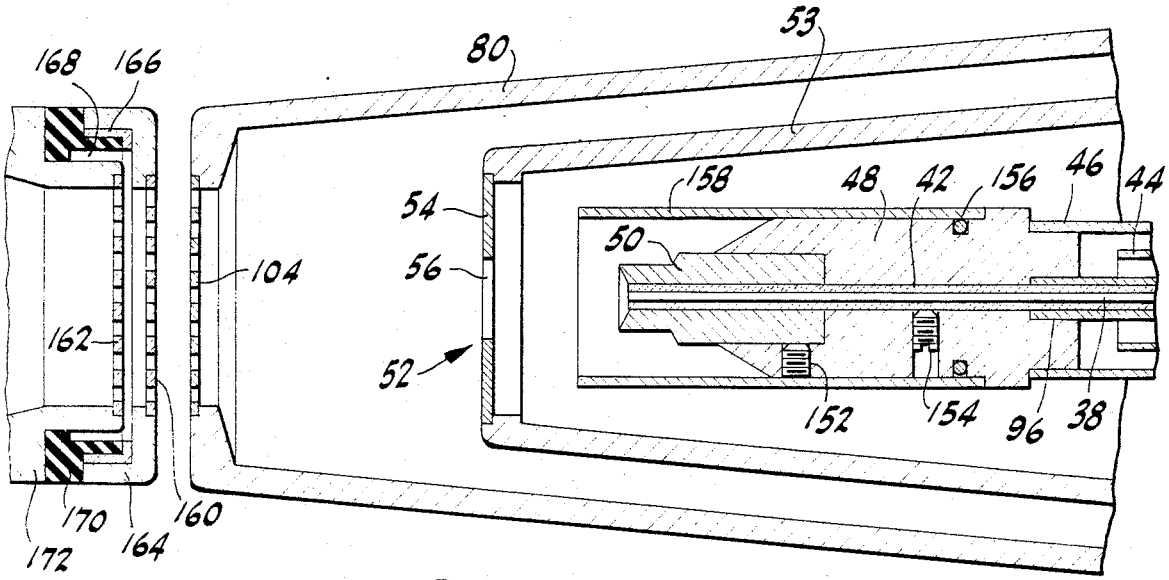
FIG. 8 is an enlarged axial sectional view of a portion of FIG. 1.

Turning to FIG. 8 it should be noted that cathode 50 is held in place within base piece 48 by set screw 152. Another set screw 154 steadies insulator 42 and trigger electrode 38 in base piece 48. 'O' ring 156 holds quartz cylinder 158 around cathode 50.

Figure 3:
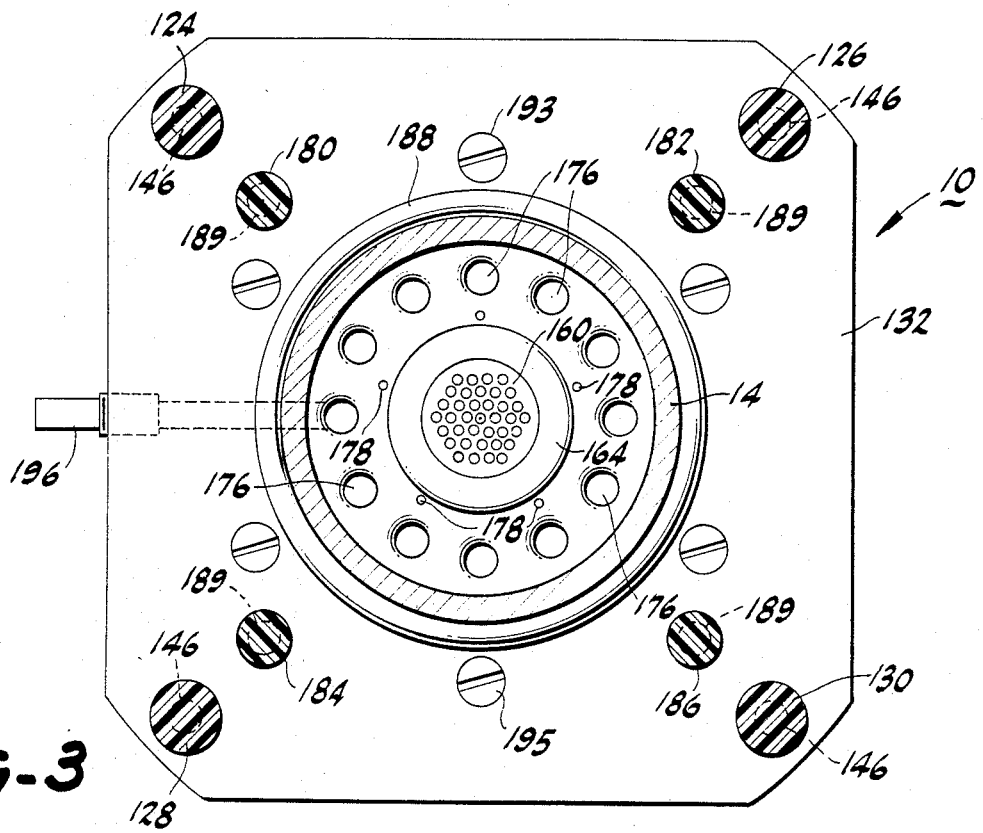
FIG. 3 is a view taken along line 3—3 of FIG. 1.
Figure 4:
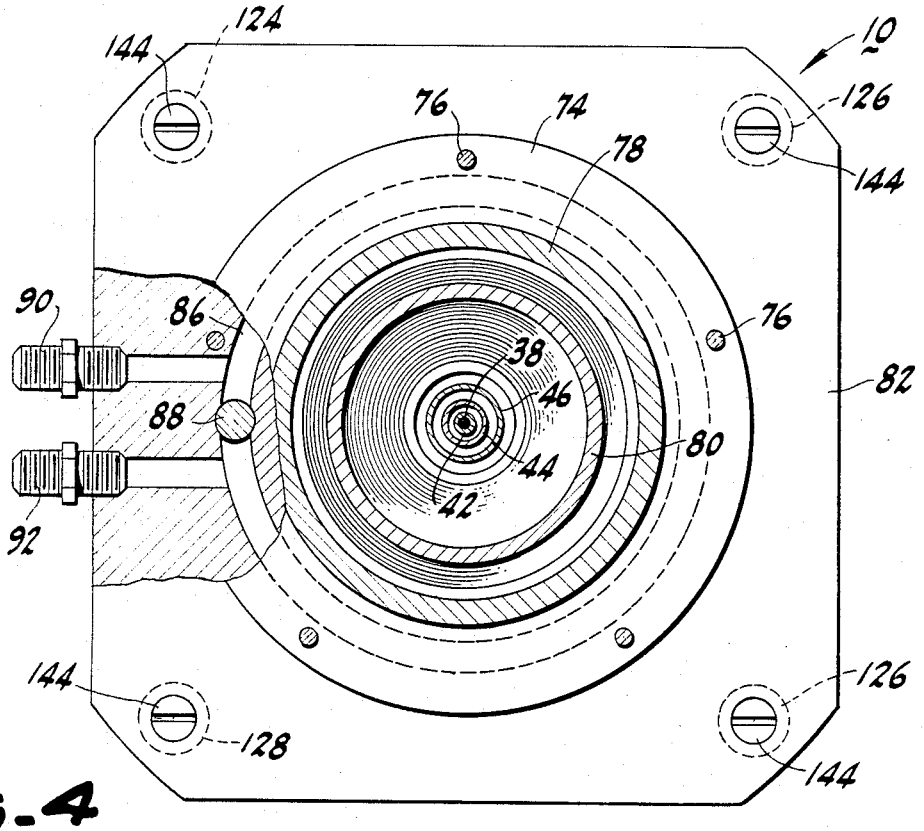
FIG. 4 is a view taken along line 4—4 of FIG. 1.

FIG. 8 also illustrates electrical grids 160 and 162 which are mounted side-by-side with electrical grid 104. With reference to FIGS. 3 and 8, it may be seen that plate 164 and insulator 170 sandwiches plate 166. Hub 172 abuts flange 174 having plurality of openings 176 therethrough. Vacuum space 168 electrically isolates grid 160 from grid 162. Flange 174, the inner portion of plate 132, is held to hub 172 via plurality of fasteners 178. Posts 180, 182, 184 and 186 hold plate 132 to plate 112 of magnetic frame member 108. Plurality of fasteners 189 (shown in phantom on FIG. 3) aid in the holding of plate 132 to magnetic frame 108. Protrusion 188 of plate 132 nests around cylindrical member 14. 'O' rings 190 and 192 hold the vacuum at this point in vacuum chamber 12. Structure 194 represents the ultimate use for the ion beam emerging from apparatus 10. It is assumed that vacuum space 32 would include a portion of structure 194. Fasteners 193 and 195, FIGS. 1 and 3 hold plate 132 to structure 194 and represent a plurality of such fasteners.

Electrical fitting 196 connects to the grid structure hereinabove described. Likewise, electrical fitting 197, FIG. 2 electrically connects to grid holder 80 and grid 104 through grid plate 82.

Figure 9:
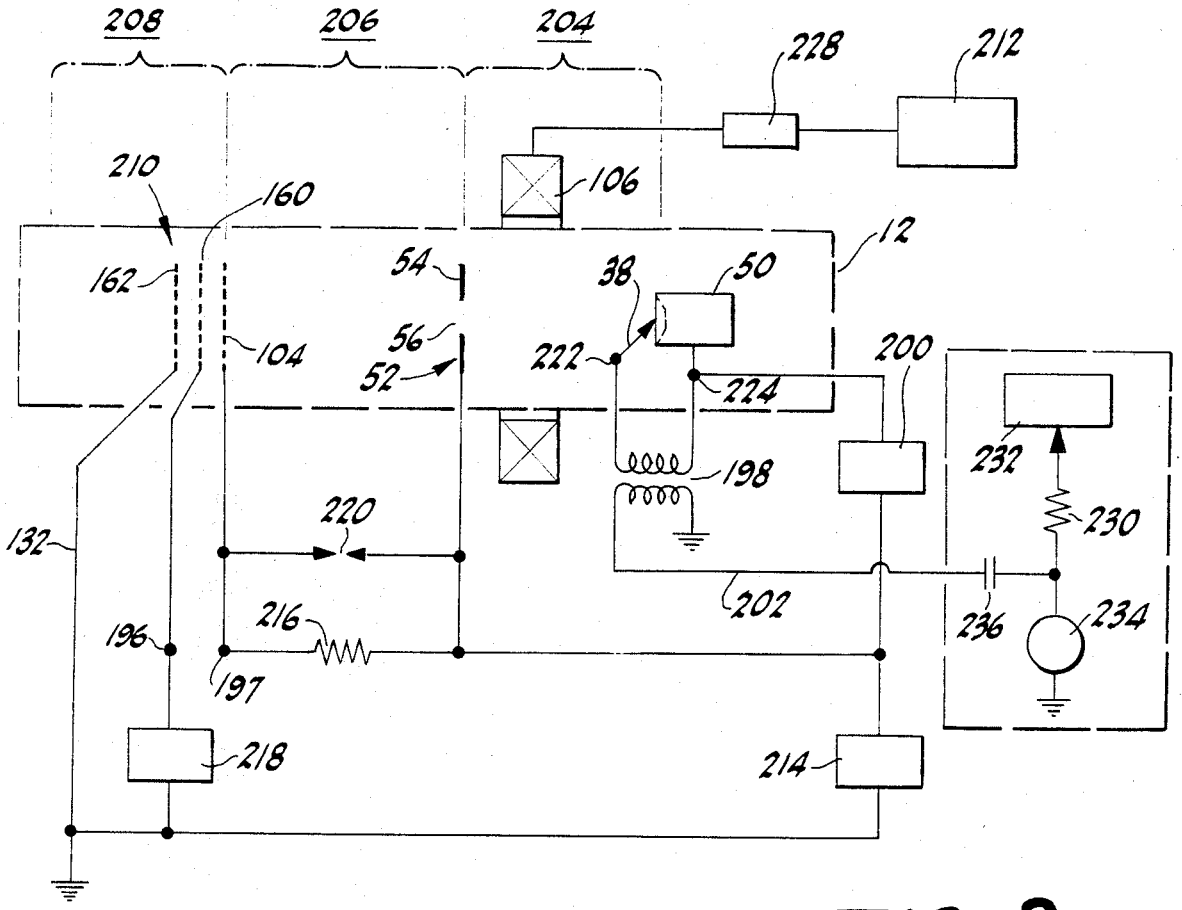
FIG. 9 is a schematic view of the operation of the apparatus of the present invention.

Turning to FIG. 9, it may be seen that cathode 50 and trigger electrode 38 are connected to pulse transformer 198. A pulse of between 10 and 20 kilovolts is produced between trigger electrode 38 and cathode 50 causing a spark therebetween. This spark initiates an arc between cathode 50 and anode plate 54 within vacuum chamber 12, liberating ionized metal vapor from cathode 50. For example, the cathode material may be tantalum, gold, carbon, aluminum, silicon, titanium, iron, niobium, lathanum hexaboride, uranium, and the like. It has been theorized that "cathode spots", tiny regions of intense current concentration, are responsible for formation of dense metal vapor plasma from cathode 50. Input 202 to pulse transformer 198 may take the form of the circuit illustrated in FIG. 9, utilizing resistor 230, power supply 232, electron tube 234, and capacitor 236.

Figure 10:
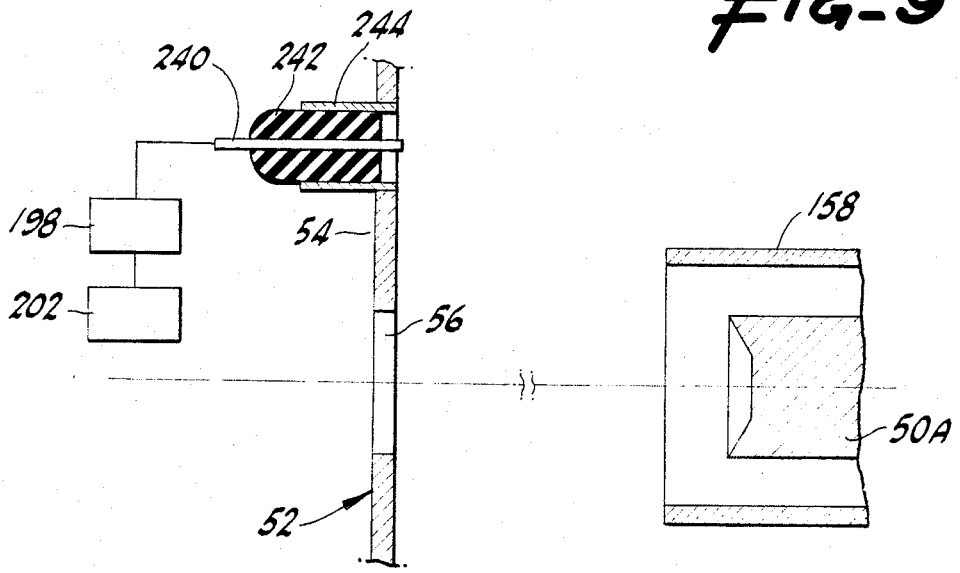
FIG. 10 is a partial sectional view of an alternate embodiment of the present invention.

Alternatively, the metal vapor vacuum arc discharge can be initiated by other means such as focusing a high power, short pulse laser beam onto cathode 50 with approximately the same results. Also, photo-electrons may be liberated from the cathode 50 surface by flooding it with ultra-violet light or soft x-rays created from a nearby trigger spark. For example, FIG. 10 shows an electrode 240 which is held in insulator 242. A metal collar 244 about insulator 242 is welded or otherwise fixed to anode plate 54. Pulse transformer 198 and input circuit 202 may be employed as will be described hereinafter with reference to FIG. 9. Cathode 50A does not include trigger electrode 38 and insulator 42 as does cathode 50.

The space between cathode 50 and anode plate 54 is referred to as the arc region 204. Plasma emanating from cathode 50 streams therefrom toward anode plate 54. Current will flow through the plasma between cathode and anode to complete the electrical circuitry shown in FIG. 9. A magnet field is established by coil 106 to guide the plasma jet from cathode 50 toward anode plate 54 and through opening 56. Annular anode 52 is located perpendicular to the cylindrical axis in the plane of the magnet field coil 106. The field in the region of the anode may be in the order of 1 KG or less. Coolant such as freon or water passes through inlet 98, tubes 44 and 46, and outlet 100 removes heat from the arc source.

An intense plasma plume passes through opening 56 in anode 52 into what is termed drift region 206. No impediments are found which would restrict the plasma from passing through opening 56.

Quartz cylinder 158 helps to direct the plasma plume through opening 56 in this regard. Magnet coil 106 utilizes a power supply 212 to further aid in the ducting of the plasma through opening 56. The plasma entering drift region 206 is dense and substantially electrically stable.

The plasma traversing drift region 206 enters extractor region 208 where means 210 is employed for extracting ions from the plasma. Means 210 is depicted in FIG. 9 and includes three grids 104, 160 and 162. Grid 104, the source grid or source electrode, connects to anode plate 54 and extractor power supply 214 through resistor 216. Grid 160, referred to as extractor or suppressor grid or electrode, is connected to suppressor power supply 218. The electric field formed between grids 104 and 160 extracts and accelerates ions from the plasma in drift region 206. Grid 162 is connected to ground.

The ion beams exiting apparatus 10 may be used in accelerators such as the super HILAC and the Bevalac as well as for ion implantation in the semiconductor processing and metallurgical fields. The intensity of the beam produced by apparatus 10 is over one Ampere, much greater than existing metal ion beam currents. The magnitude of the beam current has been confirmed by the Faraday cup and by calorimetric measurements. Although apparatus 10 has been run typically with pulse lengths of between 300 microseconds and 3 milliseconds with repetition rate of up to 10 pulses per second, it is believed that a much longer on-time may be accomplished with a cooling system having a higher capacity, resulting in yet higher ion beam intensities. Continuous (d.c.) operation is feasible, therefore. The charge state distribution of the ions produced by apparatus 10 has been measured and has been repeated in successive runs of apparatus 10. The emittance of ion beam has been measured at 0.05 pi centimeter milliradians (normalized).

In operation, electrical terminals 222 and 224 are connected to pulse transformer 198. Terminal 224 connects to the cathode 50 while terminal 222 connects to the trigger electrode 38. Terminal 226 connects to the positive leads of the arc and extractor power supplies 200 and 214, and to resistor 216 intermediate anode plate 54 and grid 104. Fittings 196 and 197 connect to grids 160 and 104 respectively. Grid 162 is grounded through plate 132. At this point, coolant is circulated through flange 58 of anode holder 53, flange 82 of grid holder 80, and copper tubes 44 and 46. Coolant is also circulated through magnet frame 108 and through fittings 114, 116, 118 and 120. Magnet coil 106 activates via terminals 134 and 136. Temperature shut-off switch 228 now monitors the temperature of coil 106. Power supplies 200, 212, 214, 218 are turned "on". Pulsing circuit 202 begins the firing of trigger electrode 38 at a rate of several per second. A spark between electode 38 and cathode 50 initiates the arc between cathode 50 and anode plate 54. A small portion of cathode 50 is ionized at this juncture. The arc or discharge between cathode 50 and anode plate 54 grows from this spark. Power supply 200 provides a pulsed power supply which determines the duration of the arc between cathode 50 and anode plate 54. Power supply 200 may, in certain cases, provide a steady source of electrical energy to the cathode 50, but the cooling mechanism heretofore described must possess a higher capacity from the present embodiment. The arc or discharge passes through anode opening 56 and travels to extractor means 210. At grid 104 a boundry between the plasma and non-plasma occurs. Menisci form at the openings of grid 104 and are convex toward drift region 206. Such menisci are so shaped as a result of an electric field between grids 104 and 160. Electrons in the plasma plume in drift region 206 remain there. The electric field between grids 160 and 162 repels electrons originating in structure or target 194. This is necessary to prevent back-streaming electrons from overloading extractor power supply 214, breaking down the gap between grids 104 and 160, and generally degrading the performance of apparatus 10. The ion beam emerging from apparatus 10 may be employed as desired.

The following is a table of components typically used in the circuitry shown in FIG. 9.:

| ITEM | MODEL # | SOURCE |
|---|---|---|
| Pulse transformer 198 | TR136B | EG & G, Boston, Ma. |
| Arc power supply 200 | "Pulse & Digital Cir." Chpt. 10, pge. 291–304 | Millman and Taub McGraw Hill 1956 |
| Magnetic power supply 212 | DCR40-250A | Sorensen Co. Manchester, N.H. |
| Extractor power supply 214 | BRE30-800 | Universal Voltronics Corp. Mount Kisco, N.Y. |
| Resistor 216 | 500 OHM 10 watt | Ohmite Co. Skokie, Il. |
| Suppressor power supply 218 | HV-1544 | Power Designs Co. Palo Alto, Ca. |
| Resistor 230 | 1 MOHM 10 watt | Ohmite Co. Skokie, Il. |
| Power supply 232 | HV-1584R | Power Designs Co. Palo Alto, Ca. |
| Electron Tube 234 | 5C22 Thyratron | I.T.T., Easton, PA. |
| Capacitor 236 | 0.IMF 15 KV | G.E. Schnectady, N.Y. |

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An ion generating apparatus comprising:

a. a structure providing a vacuum chamber;

b. a cathode and an anode placed apart a selected distance in one region within said vacuum chamber;

c. a source of electrical power defining an electrical potential between said cathode and anode;

d. means for producing an electrical arc between said cathode and anode sufficient to vaporize and ionize a portion of said cathode to form a plasma;

e. means for guiding said plasma away from said cathode and anode region in a predetermined direction to another region spaced from said anode and cathode;

f. means for extracting ions from said plasma in said another region spaced from said cathode and anode region.

2. The apparatus of claim 1 in which said extracting means is placed within said vacuum chamber a selected distance from said cathode and said anode.

3. The apparatus of claim 1 in which said means for producing an electrical arc between said cathode and anode includes a trigger electrode connected to a source of electrical voltage, said trigger electrode being positioned adjacent said cathode.

4. The apparatus of claim 3 in which said cathode includes a passage therethrough and said trigger electrode extends into said passage, and said means for producing an electrical arc further comprises an electrical insulator placed in said cathode passage between said cathode and trigger electrode.

5. The apparatus of claim 1 in which said means for guiding said plasma away from said cathode and anode region includes an opening through said anode for permitting passage of said plasma from said cathode.

6. The apparatus of claim 1 in which said means for guiding said plasma away from said cathode and anode region includes means for applying a magnetic field to said plasma generated at said cathode.

7. The apparatus of claim 6 in which said means for applying a magnetic field to said plasma includes a field coil which surrounds a portion of said anode.

8. The apparatus of claim 1 in which said means for extracting ions from said plasma includes a plurality of grids spaced apart from said cathode and anode, said plurality of grids being connected to a source of electrical power for producing an electric field between at least two of said plurality of grids.

9. The apparatus of claim 8 in which said plurality of grids includes at least one grid which is electrically grounded.

10. The apparatus of claim 1 in which said means for producing an electrical arc between said cathode and anode includes electrode mounted in the vicinity of said anode, said electrode being connected to a source of electrical voltage such that a spark discharge occurs between said electrode and said anode.

* * * * *